United States Patent [19]

Buck

[11] Patent Number: 4,832,651

[45] **Date of Patent: * May 23, 1989**

[54] INFLATED BALLOON TIRE FOR TOY VEHICLES

[76] Inventor: Gordon H. Buck, 3784 Newton St., Torrance, Calif. 90505

[ * ] Notice: The portion of the term of this patent subsequent to Sep. 15, 2004 has been disclaimed.

[21] Appl. No.: 22,760

[22] Filed: Mar. 6, 1987

[51] Int. Cl.[4] ..... A63H 17/26; B60C 23/10; B60B 27/00

[52] U.S. Cl. ..... 446/224; 446/465; 152/427; 301/105 R

[58] Field of Search ..... 446/224, 222, 220, 465; 152/415, 427, 380; 301/5 VH, 63 PW, 5 R, 105 R, 1

[56] References Cited

U.S. PATENT DOCUMENTS

| | | | |
|---|---|---|---|
| 1,997,115 | 4/1935 | Merz, Jr. et al. | 446/465 |
| 2,165,536 | 7/1939 | Chappell | 446/224 X |
| 2,871,905 | 2/1959 | Stanton | 152/427 X |
| 4,094,347 | 6/1978 | Ikemoto | 446/220 X |
| 4,693,696 | 9/1987 | Buck | 446/224 |

FOREIGN PATENT DOCUMENTS

| | | | |
|---|---|---|---|
| 926008 | 9/1947 | France | 446/465 |

*Primary Examiner*—Mickey Yu

[57] ABSTRACT

There is disclosed a toy balloon tire and a wheel. The wheel is an assembly of two hub members each having a peripheral rim about its outer end. An annular land is provided between the opposite ends, and a through passageway is provided in one hub member communicating with a port discharging into the tire. A valve is provided to seal the passageway. The balloon tire has a central opening in one of its sidewalls which is surrounded by a bead. The bead is received over the hub of the wheel and is seated against an annular rim of one of the hub members. The wheel can have a mechanical valve member mounted in the through passageway. Alternatively, the tire itself can seal the passageway and function as the valve. In the preferred embodiment, the passageway discharges into the interior of the tire through a port which is located in the annular land of the hub, between its opposite ends. When the tire is placed on the hub, the annular skirt of the tire overlies the annular land of the hub and functions as a valve member. Pressure relief passageways can be provided which extend through one of the hub rims and open into the annular land of the hub.

The tire can be inflated by the application of air pressure to the through passageway. Once inflated, the air is retained in the tire of the valve. In the event the tire is overinflated, it expands sufficiently to uncover the relief passageways, and relieve the excessive pressure.

5 Claims, 3 Drawing Sheets

INFLATED BALLOON TIRE FOR TOY VEHICLES

BACKGROUND OF THE INVENTION

1. Field of the Invention

This invention relates to an inflatable tire and hub assembly for toys, and in particular to a hub assembly utilizing a balloon tire 2. Brief Statement of the Prior Art Toy vehicles have been provided with wheels of various shapes to simulate balloon tires. Hollow form wheels of rigid materials are shown in U.S. Pat. Nos. 3,263,363; 3,264,780; 3,649,048; and 4,411,639. Solid form wheels which are formed of a soft compressible material, such as an elastomer, are disclosed in U.S. Pat. Nos. 3,561,863; and 3,445,958. Similar wheels are disclosed as being covered with an outer coating or fabric in U.S. Pat. Nos. 3,438,770 and 4,146,992. In all of these prior wheels, the tire was either formed of a rigid supporting material, or was formed of a soled core, compressible material, to simulate an inflated balloon tire.

U.S. Pat. No. 3,264,780 disclosed a hollow form rubber tire without any inflation pressure. U.S. Pat. No. 1,997,115 discloses an early attempt to provide an inflated balloon tire. According to the latter patent, a female hub member was placed about the neck of a balloon, the balloon was inflated, and a male hub element was then inserted and cemented in place. A third hub element was then cemented about the outside face of the female hub member. The patented invention has a complex structure which is unsuited for mass production, and has the following failings: the permanent attachment of the balloon to the hub, the inability to change tires, and the failure to provide an inflation valve.

BRIEF DESCRIPTION OF THE INVENTION

This invention comprises a toy balloon tire and a wheel. The wheel has a hub member having a peripheral rim about each of its ends with an annular land therebetween, and a through passageway opening into a port discharging into said tire, with a valve sealing the passageway. The balloon tire has a central opening in one of its sidewalls which is surrounded by a bead. The bead is received over the hub of the wheel and is seated against an annular rim on the hub member. The wheel can have a mechanical valve member mounted in the through passageway. Alternatively, the tire itself can seal the passageway and function as the valve. Two embodiments of this are disclosed. In the first embodiment, the tire has central openings in both of its side walls, and the annular skirt of the tire which surrounds its central opening seals the passageway. For this purpose, the passageway discharges into the interior of the tire through a port which is located in the annular land of the hub, between its opposite ends. When the tire is placed on the hub, the annular skirt of the tire overlies the annular land of the hub and functions as a valve member. In the second embodiment, one side wall of the tire has no opening, and the unbroken side wall seals the passageway. In this embodiment, the passageway discharges into the tire through a port in an internal end wall of the hub, and the unbroken side wall of the tire overlies this port to function as the valve member. Pressure relief passageways can be provided which extend through one of the hub rims and open into the annular land of the hub.

The tire can be inflated by the application of air pressure to the through passageway. Once inflated, the air is retained in the tire by the valve. In the event the tire is overinflated, it expands sufficiently to uncover the relief passageways, and relieve the excessive pressure.

BRIEF DESCRIPTION OF THE DRAWINGS

The invention will be described by reference to the FIGURES, of which.

DESCRIPTION OF PREFERRED EMBODIMENTS

Figure 1:
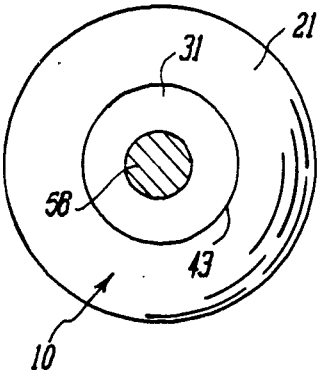
FIG. 1 is a side view of the tire and hub assembly of the invention.

Referring to FIG. 1, the invention is shown as a tire and hub assembly 10 which is formed of a balloon tire 21 mounted on a hub. The hub is formed of two opposite end hub members 31 and 38 (see FIG. 3). Hub member 31 has a first peripheral rim 43 about one end, and is mounted on a shaft 56. Preferably the face of hub 31 is flat.

Figure 2:
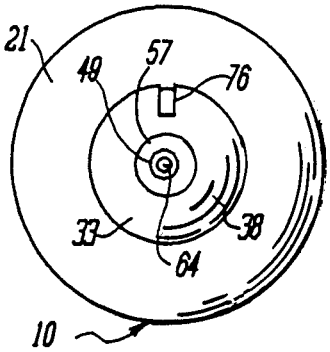
FIG. 2 is a view of the opposite side of the tire and hub assembly of FIG. 1.

Referring now to FIG. 2, the opposite side of the tire and hub assembly is illustrated. The hub member 38 has a peripheral annular rim 33 and has a through passageway 49 which extends into the interior of the balloon tire 21. Passageway 49 has an enlarged diameter counterbore 57. The rim 33 also has at least one axial slot 76 which serves as a relief passageway, as described later. The face of the hub shown in this view can be flat or can have an arcuately convex contour with the annular rim 33 contiguous thereto.

Figure 3:
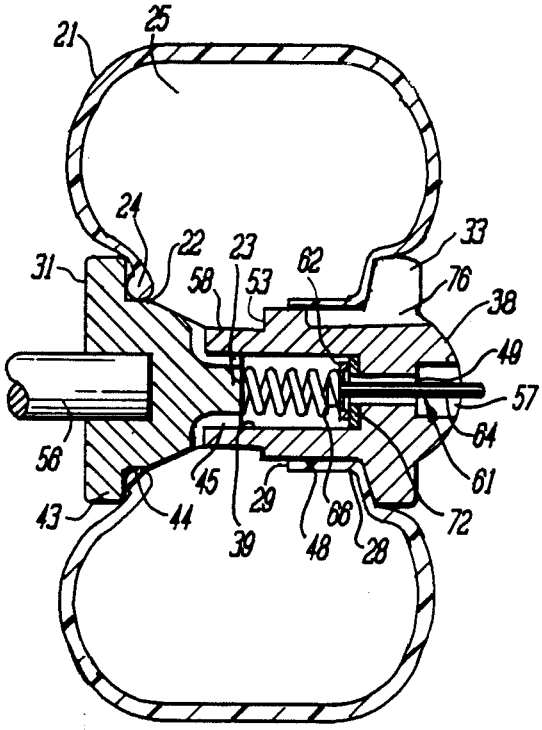
FIG. 3 is an elevational sectional view of the tire and hub assembly of the invention.

Referring now to FIG. 3, the tire and hub of the invention are illustrated an elevational cross-section view. The tire 21 is received over the assembly of hub members 31 and 38. The tire 21 has a central opening 22 with a peripheral, coextensive bead 24 which is seated against rim 43. On its opposite sidewall, the tire has an annular skirt 28 which surrounds a hole 29 centrally located in the sidewall.

The hub of the tire is formed of a first hub member 31 and a second hub member 38 which are assembled and permanently secured by bonding, solvent welding, etc. For this purpose, the first member 31 has a reduced diameter neck 23 which is received in counter bore 39 of central through passageway 49. One or more grooves 45 are provided in reduced diameter neck 23 of the first hub member 31 to communicate between the interior 25 of the balloon tire 21 and the interior of counter bore 39.

As previously mentioned, the first hub member 31 has a peripheral rim 43 which extends about the entire periphery of the hub member and serves as a seat with an annular shoulder 44 that receives the annular bead 24 of balloon tire 21.

The second hub member 38 also has an annular rim 33 which preferably is contiguous with an annular land 48 which extends between the two hub members. The inside surface of annular rim 33 is inclined at an angle greater than 90 degrees with respect to annular land 48. The annular land 48 receives the annular skirt 28 of the balloon tire 21. Preferably, annular land 48 is stepped with a small diameter end 58, providing an annular shoulder 53 therebetween. This shoulder is used in assembly of the tire as it serves as a stop against which the central opening 29 of the tire can be placed.

The tire assembly includes a suitable valve 61 which can have a valve member 62 which is distally carried on a rod 64. The valve member 62 is urged into a closed position by compression spring 66 that bears against its inner face and seats against the received end face of the reduced diameter neck 23 of first hub member 31. A resilient seal or packing 72 is provided to present a compressible annular seat for valve member 62.

Provision is made in the aforementioned tire and hub assembly for relief of excess pressure. Preferably this comprises one or more relief passageways 76 which can simply be axial slots cut into rim 33 and a short distance into the annular land 48 of the second hub member 38. As the pressure in the interior of balloon tire 21 becomes excessively large, sufficient to expand the tire, the annular skirt 28 will slide outwardly, moving the central opening 29 until it uncovers the relief passage 76 to the interior of the tire, thereby relieving the excess pressure.

The rod 64 also serves as a manual valve operator, as when it is depressed, it will lift the valve member 62 off its seat, releasing the air pressure within the tire. The rod 64 can also be used to simulate blowouts by striking the rod 64 with against an obstacle or with another vehicle sufficiently to deflect the rod 64 and relieve the tire pressure.

Figure 4:
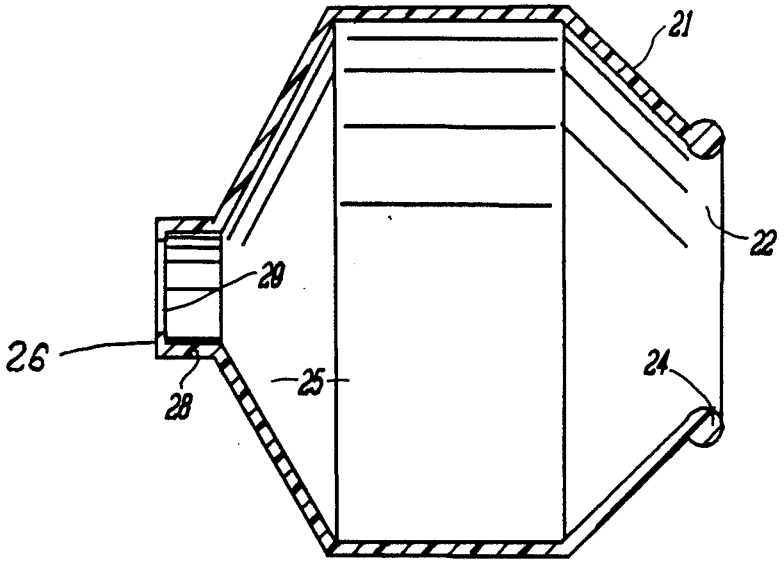
FIG. 4 is an elevational sectional view of the tire.

Referring now to FIG. 4, the balloon 21 is formed of an elastomeric material, e.g., natural or synthetic rubber latex, and can be shaped to a general tire configuration with an interior 25. The balloon has a first central opening 22 which is preferably encircled with a bead 24 of the rubber latex. The opposite sidewall of the balloon has an annular skirt 28 which centrally surrounds a small diameter hole 29. The balloon can be readily manufactured from a natural or synthetic rubber latex by conventional rubber part forming techniques. Typically this is accomplished by preparing a metal mandrel for the part which has the shape desired for the tire 21. The mandrel is coated with a latex coagulant, and dipped into a rubber latex for a sufficient time to obtain the desired thickness of the balloon wall. The mandrel is then removed, excess latex is drained, and the rubber is cured, usually by air drying, to form the rubber part. Prior to curing, the end of the part which is formed on the mandrel can be rolled to form the bead 24. After curing, the rubber part is stripped from the mandrel and opening 29 is cut in sidewall 26 to obtain the balloon 21.

Figure 5:
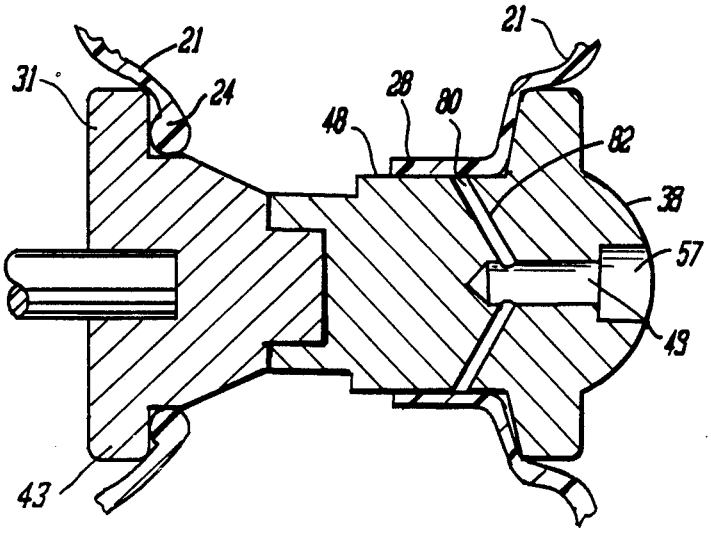
FIG. 5 is an elevational sectional view of another embodiment of the invention.

FIG. 5 illustrates an alternative embodiment of the invention. In this embodiment, the valve member is the annular skirt 28 of the balloon tire 21. The first hub member 31 is essentially the same as that previously described with reference to FIG. 3, and it has a peripheral rim 43 that serves to seat the bead 24 of tire 21.

The secod hub member 38 has the overall configuration similar to that described with regard to FIG. 3. This hub member has at least one port 80, and preferably a plurality of such ports, located in the annular land 48. In this position, the ports 80 are covered by the overlying annular skirt 28 of the balloon 21 in the hub and tire assembly. The ports 80 communicate with the interior longitudinal passageway 49 of the hub member 38. For this purpose, a plurality of small passageways 82 can be bored into the hub member 38, terminating in the central passageway 49.

When the tire is inflated, the air pressure applied externally to the passageway 49 will lift the annular skirt 28, discharging the air into the interior of the tire. When the air pressure applied to the passageway 49 is removed, the superatmospheric pressure in tire 21 will close the annular skirt 28 tightly against the ports 80, sealing the tire. In the event that excessive inflation pressure is applied, the tire will flex outwardly, sliding skirt 28 along annular land 48. When the skirt 28 has slid sufficiently that it uncovers one or more ports 80, the pressure in the tire will be relieved through the passageway 49.

Figure 6:
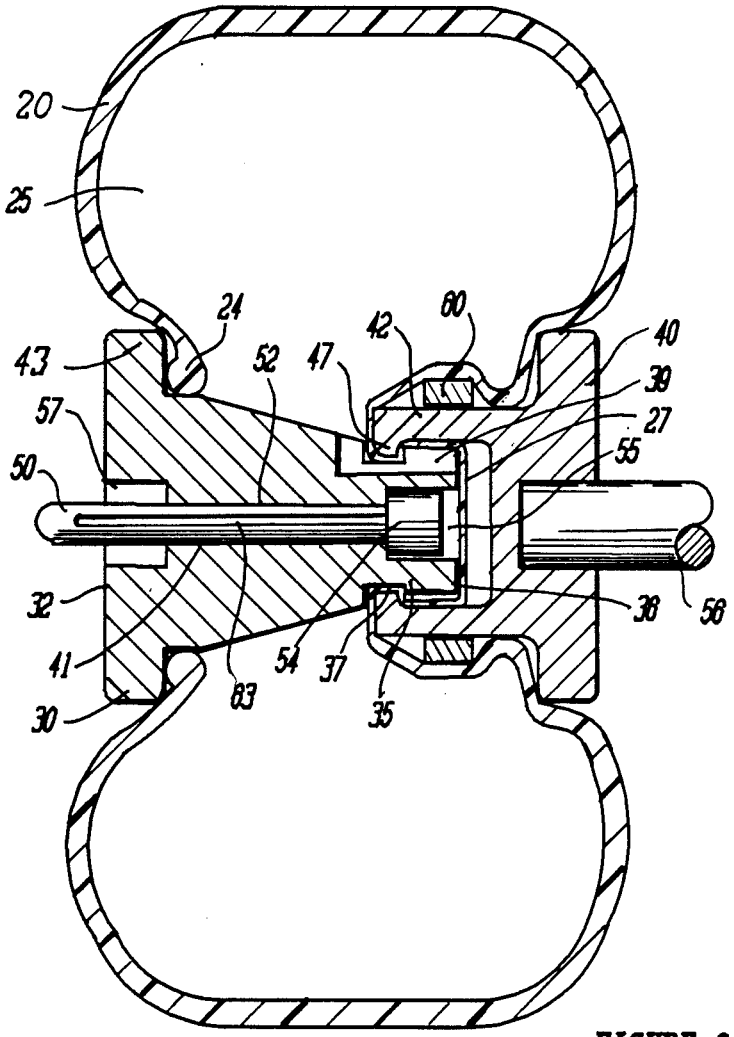
FIG. 6 is an elevational sectional view of another embodiment of the invention.

The embodiment invention shown in FIG. 6 uses the sidewall of the tire as the valve member. This embodiment uses a balloon 20 which does not have a opening in both sidewalls, and a hub assembly of two interlocking hub members; hub member 30 and cap hub member 40. These hub members are removably interlocked over the central portion of a sidewall of the balloon, which functions as the sealing portion of the valve. In this embodiment hub member 30 is received within balloon 20 with bead 24 firmly secured against the peripheral rim 43. The sealing portion 27 of the sidewall of baloon 20 is stretched tightly across the sealing face 36 of the inner end of the hub member 30, and thus functions as a diaphragm of a valve member. The cap hub member 40 engages the inner cylindrical end 35 of the hub member 30 in a male/female cooperative engagement, with the sleeve section 42 of the cap hub member 40 received about the cylindrical section 35 of the hub member 30. The retention of the assembly is enhanced by detent means comprising the annular groove 37 in hub member 30 which receives the annular lip 47 of the cap hub member 40. This lip 47 is firmly seated and locked in engagement with annular groove 37 by retainer ring 60 which is slipped over the assembled hub members.

The cap hub member 40 can have a central bore to receive a stub shaft 56 for mounting the wheel assembly to a toy vehicle.

The valve release member 50 is shown in the through passageway 41 with its head 54 received in the counterbore 55 of passageway 41, and with its shaft 52 extending through the passageway and projecting beyond the outer face 32 of the hub member 30. Preferably the passageway 41 is also counterbored at 57 to receive the end of an air supply conduit, and one or more axial grooves 63 can be provided in shaft 52 as air passageways.

Once the wheel is assembled as shown in FIG. 6, it can be inflated by the application of a pressured source of air to the central passageway 41. The air pressure is sufficient to overcome the tension on the sealing portion 27 of balloon 20, lifting it from the sealing face 36. The air then passes along the axial groove 39 in the cylindrical section 35 of the hub member 30, entering the interior 25 of the balloon 20. When the pressured source of air is removed from passagewy 41, the sealing portion 27 of the balloon 20 reseats against the sealing face 36 of the hub member 30, retaining the balloon at the inflation pressure. If the air is to be released, the valve release member 50 is pressed, forcing head 54 against sealing portion 27 of the balloon, lifting it off the sealing face 36 and releasing the air from the interior of the balloon.

The invention provides a number of features and advantages which can be utilized in various applications. The inflated tire provides a realism for toy vehicles which has not been achieved in prior tire assemblies, since the tires can be inflated to a desired operating pressure; tires can be changed for different operations, e.g., deep treads can be applied to simulate off-road racing, or slick tires with little or no tread can be applied to simulate dragster racing; blow-outs can be simulated, e.g., when the valve operator is struck or deflected by an obstruction on the track, or by a competitive racing vehicle. Competitive racing can include required tire changes in pit stops, thereby heightening the competition between racers. The tires, which are rubber balloons of a special shape and design, can be manufactured simply and inexpensively, and can be manufactured in a wide variety of shapes, i.e., profiles, and tread designs, all contributing to a high degree of realism of the toy vehicle. The ease of manufacture of the tires also permits custom tire preparation, thus permitting experimentation with different shapes and tread designs, thereby providing serious racing fans with an added dimension in competitive racing. The extremely low weight of the hub assembly and tire can also provide an advantage for model aircraft applications. As a further advantage, toy tire chains can be applied to the tire; preferably by slightly deflating the tire, applying the tire chains and securing them about the tire, and then inflating the tire to apply the desired tension to the surrounding tire chains.

The invention has been described with reference to the illustrated and presently preferred embodiment. It is not intended that this disclosure of the presently preferred embodiment be unduly restricting. Instead, it is intended that the invention be defined by the means, and their obvious equivalents, set forth in the following claims:

What is claimed is:

1. A toy tire assembly comprising:

a. a hub having first and second peripheral rims, one about each end thereof, with an annular land therebetween;

b. an elastomeric balloon tire received over said hub and together with said hub defining an interior chamber, said balloon tire having a central opening in a first sidewall thereof with a peripheral, coextensive bead defining said opening and is seated against an inner surface of said first rim, and an annular skirt portion on an opposite sidewall thereof which is slidably received over said annular land of said hub and is against an inner surface of said second rim;

c. a port in said hub opening into said interior chamber of said tire, and a through passageway in said hub, communicating from the outside of said hub, through said hub, to said port;

d. a valve member carried by said hub, sealing the interior chamber of said tire;

e. an interior chamber in said hub which receives said valve member, and a resilient spring also received in said interior chamber of said hub to bias said valve member into a closed position;

f. a rod carrying said valve member, which is mounted in said passageway and is projected axially from said hub; and g. said inner surface of said second rim, underlying said annular skirt, is inclined at an angle greater than 90 degrees with respect to said annular land of said hub to allow said skirt to slide along said annular land when said tire is subjected to internal pressure.

2. The toy tire assembly of claim 1 wherein one of said rims is contiguous to said annular land.

3. The toy tire assembly of claim 1 wherein said hub is formed of first and second hub members.

4. A toy tire assembly comprising:

a. a hub having peripheral rims, one about each end thereof, with an annular land therebetween;

b. an elastomeric balloon tire received over said hub and together with said hub defining an interior chamber, said balloon tire having at least an annular skirt portion overlying said annular land of said hub;

c. a port in said annular land of said hub opening into said interior chamber of said tire, and a through passageway in said hub communicating from the outside of said hub, through said hub, to said port, whereby said annular skirt acts as a valve member, covering said port and sealing said interior chamber of said tire from said port; and d. an inside surface on one of said rims underlying said tire skirt and is inclined at an angle greater than 90 degrees with respect to said annular land of said hub to allow said tire skirt to slide along said annular land when said balloon tire is subjected to internal pressure, thereby uncovering said port in said annular land, making said valve member operate to relieve any excess pressure in said tire.

5. The toy tire assembly of claim 4 wherein one of said rims is contiguous to said annular land.

* * * * *